US010610715B1

(12) United States Patent
Taylor

(10) Patent No.: US 10,610,715 B1
(45) Date of Patent: Apr. 7, 2020

(54) BARRIER PIERCING FIREHOUSE NOZZLE ASSEMBLIES

(71) Applicant: Michael Taylor, Shreveport, LA (US)

(72) Inventor: Michael Taylor, Shreveport, LA (US)

( * ) Notice: Subject to any disclaimer, the term of this patent is extended or adjusted under 35 U.S.C. 154(b) by 65 days.

(21) Appl. No.: 15/985,299

(22) Filed: May 21, 2018

(51) Int. Cl.
*A62C 31/22* (2006.01)
*A62C 31/07* (2006.01)
*A62C 31/03* (2006.01)

(52) U.S. Cl.
CPC ..... *A62C 31/22* (2013.01); *A62C 31/03* (2013.01); *A62C 31/07* (2013.01)

(58) Field of Classification Search
CPC ..... A62C 31/22; A62C 31/03; A62C 31/05; A62C 31/07
USPC ..... 239/271, 272; 285/145.1, 145.2
See application file for complete search history.

(56) References Cited

U.S. PATENT DOCUMENTS 3,134,545 A * 5/1964 Armond ..... E03C 1/046 239/312
3,667,788 A * 6/1972 Greenwood ..... F16B 7/1427 403/104
4,485,877 A * 12/1984 McMillan ..... B05B 1/02 169/48
6,866,512 B2 3/2005 Ebersole, Jr. et al.
9,061,168 B2 * 6/2015 Mikota ..... A62C 31/22
2005/0274825 A1 12/2005 Seguin
2015/0075820 A1 * 3/2015 Grant ..... A62C 31/02 169/14

* cited by examiner

*Primary Examiner* — Jason J Boeckmann
(74) *Attorney, Agent, or Firm* — R. Keith Harrison

(57) ABSTRACT

Illustrative embodiments of the disclosure are generally directed to barrier-piercing firehose nozzle assemblies suitable for selective application of water and/or other extinguishing liquid to an open fire or piercing a ceiling, floor or other barrier and applying the liquid to a fire concealed above, below or on the other side of the barrier. An illustrative embodiment of the barrier-piercing firehose nozzle assemblies may include a nozzle inlet housing having an inlet housing interior. A spray nozzle may be disposed in fluid communication with the inlet housing interior. A barrier-piercing applicator may be disposed in fluid communication with the inlet housing interior. The barrier-piercing applicator may be selectively deployable between a retracted position and an extended position. At least one discharge opening may be provided in the barrier-piercing applicator. A selector valve may be provided in the inlet housing interior. The selector valve may be selectively deployable in a first valve position in which the selector valve is disposed in fluid communication with the spray nozzle and a second valve position in which the selector valve is disposed in fluid communication with the barrier-piercing applicator.

11 Claims, 13 Drawing Sheets

BARRIER PIERCING FIREHOUSE NOZZLE ASSEMBLIES

FIELD

Illustrative embodiments of the disclosure generally relate to firehose nozzles. More particularly, illustrative embodiments of the disclosure relate to barrier piercing firehose nozzle assemblies which are suitable for selective application of water and/or other fire extinguishing liquid to an open fire or piercing a ceiling, floor or other barrier and applying the liquid to a fire concealed above, below or on the other side of the barrier.

SUMMARY

Illustrative embodiments of the disclosure are generally directed to barrier-piercing firehose nozzle assemblies suitable for selective application of water and/or other fire extinguishing liquid to an open fire or piercing a ceiling, floor or other barrier and applying the liquid to a fire concealed above, below or on the other side of the barrier. An illustrative embodiment of the barrier-piercing firehose nozzle assemblies may include a nozzle inlet housing having an inlet housing interior. A spray nozzle may be disposed in fluid communication with the inlet housing interior. A barrier-piercing applicator may be disposed in fluid communication with the inlet housing interior. The barrier-piercing applicator may be selectively deployable between a retracted position and an extended position. At least one discharge opening may be provided in the barrier-piercing applicator. A selector valve may be provided in the inlet housing interior. The selector valve may be selectively deployable in a first valve position in which the selector valve is disposed in fluid communication with the spray nozzle and a second valve position in which the selector valve is disposed in fluid communication with the barrier-piercing applicator.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
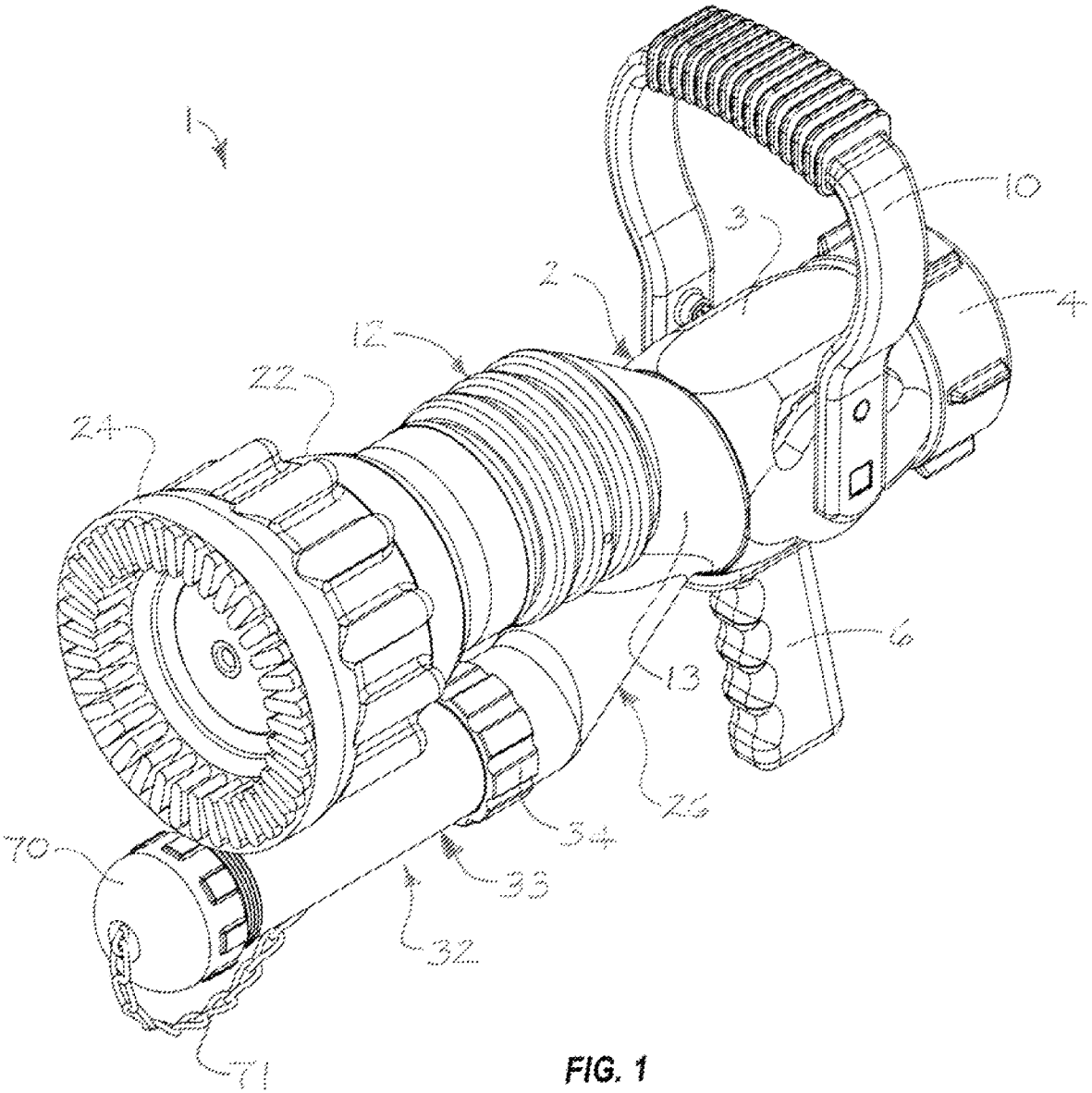
FIG. 1 is a front left side perspective view of an illustrative embodiment of the barrier piercing firehose nozzle assemblies, with the extendible barrier-piercing applicator of the assembly shown in a retracted, non-functional position.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 19:
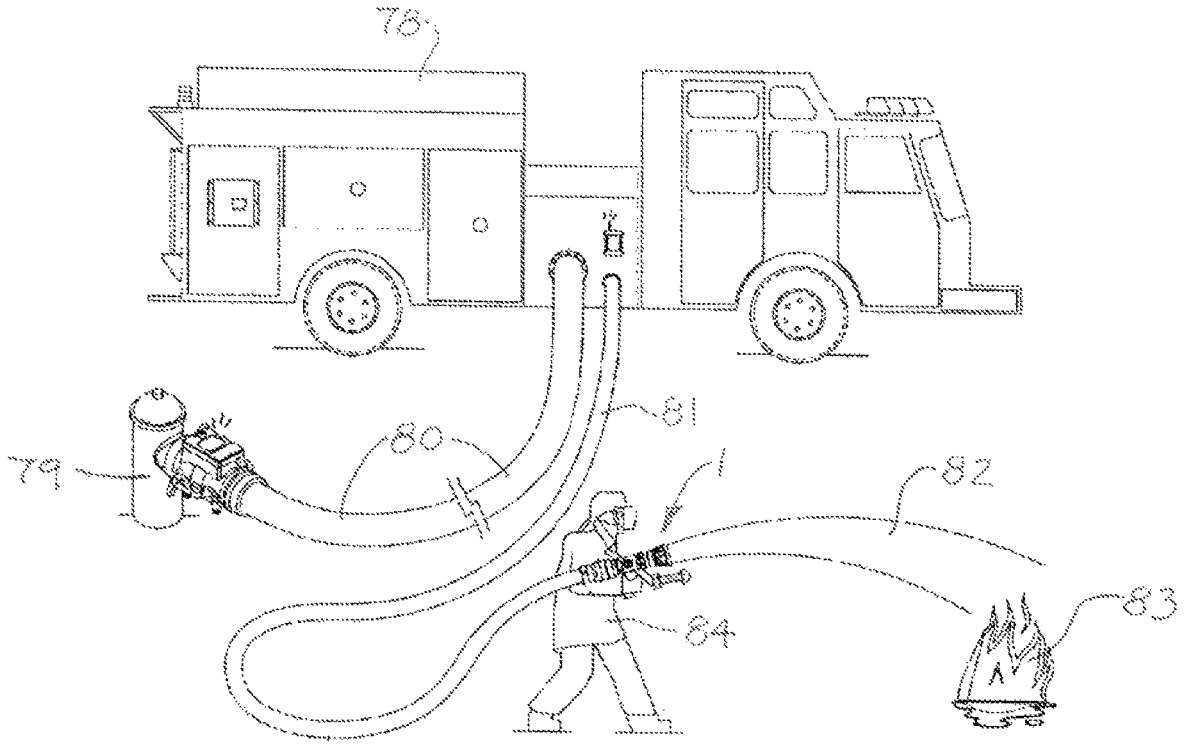
FIG. 19 is a side view of a firetruck with an illustrative embodiment of the barrier piercing firehose nozzle assembly connected to the firetruck through a firehose and water being ejected from the spray nozzle of the assembly onto a fire in typical application of the assembly.
Figure 20:
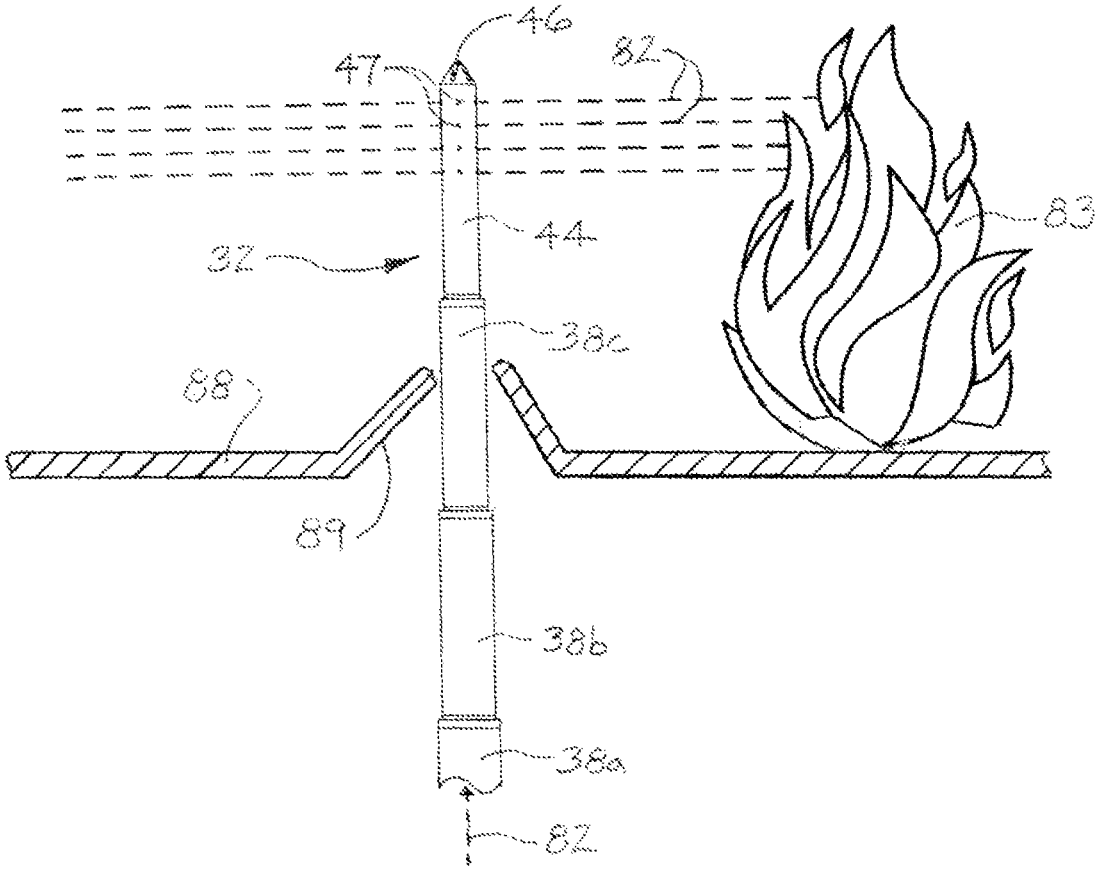
FIG. 20 is a side view, partially in section, of the extended barrier-piercing applicator of the assembly, extending through a puncture opening in a ceiling (illustrated in section) and more particularly illustrating water being ejected from the barrier-piercing applicator into a fire above the ceiling in another application of the assembly.

Referring initially to FIGS. 19 and 20 of the drawings, an illustrative embodiment of the barrier piercing firehose nozzle assemblies, hereinafter assembly, of the disclosure is generally indicated by reference numeral 1. As illustrated in FIG. 19, in typical application, which will be hereinafter described, the assembly 1 may be suitable for selective application of water 82 and/or other fire extinguishing liquid, hereinafter water 82, to an open fire 83. As illustrated in FIG. 20, in other applications, the assembly 1 may be suitable for piercing a barrier such as a ceiling 88, or alternatively, a floor or other barrier (not illustrated) and applying the water 82 to a fire 83 which is concealed above the ceiling 88, or below or on the other side of the other barrier. The assembly 1 may be amenable to alternative firefighting or other applications, as will become apparent by consideration of the following detailed description.

Figure 5:
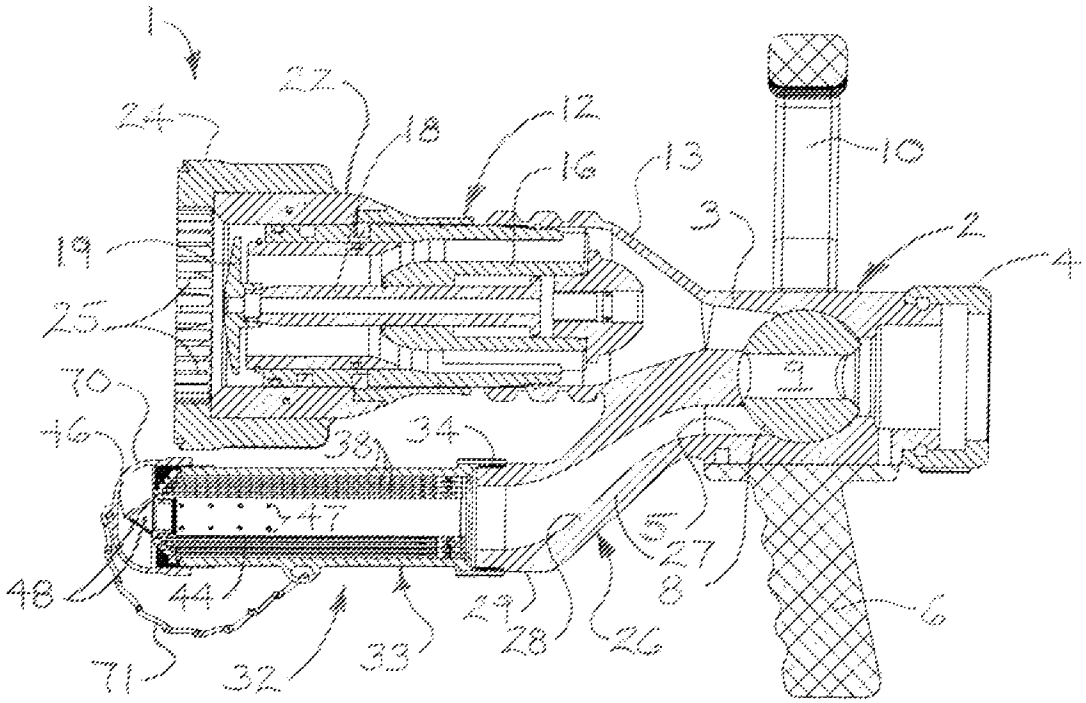
FIG. 5 is a longitudinal sectional view of the illustrative barrier piercing firehose nozzle assembly and retracted barrier-piercing applicator with a selector handle of the assembly shown in a neutral, middle handle position.
Figure 6:
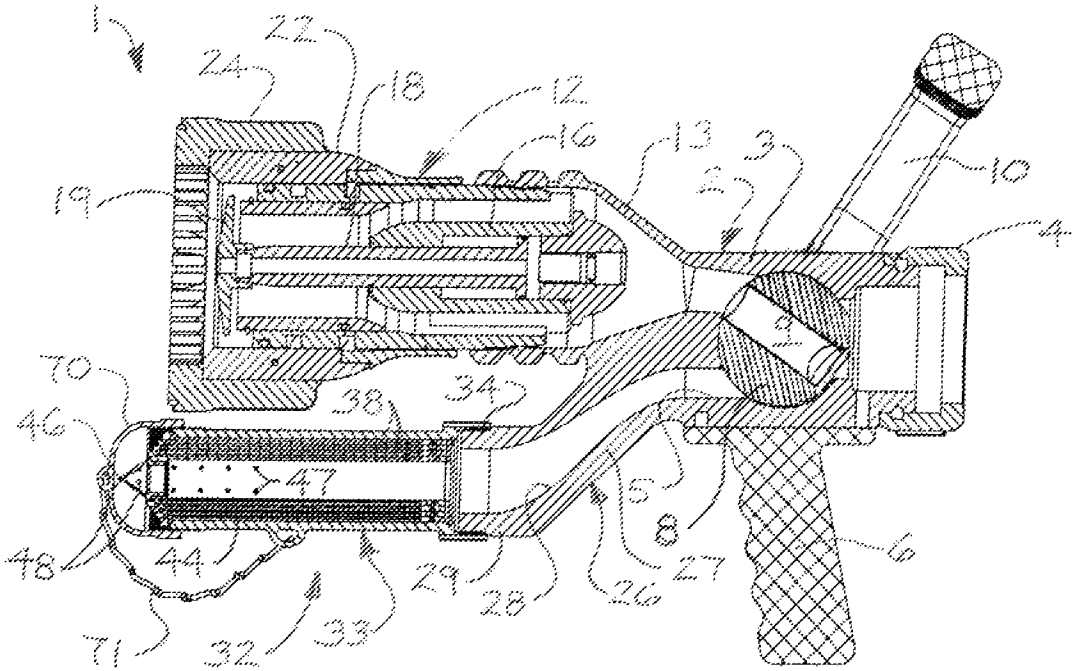
FIG. 6 is a longitudinal sectional view of the illustrative barrier piercing firehose nozzle assembly and retracted barrier-piercing applicator with the selector handle shown in a rear handle position for ejection of water from a spray nozzle on the nozzle assembly.
Figure 7:
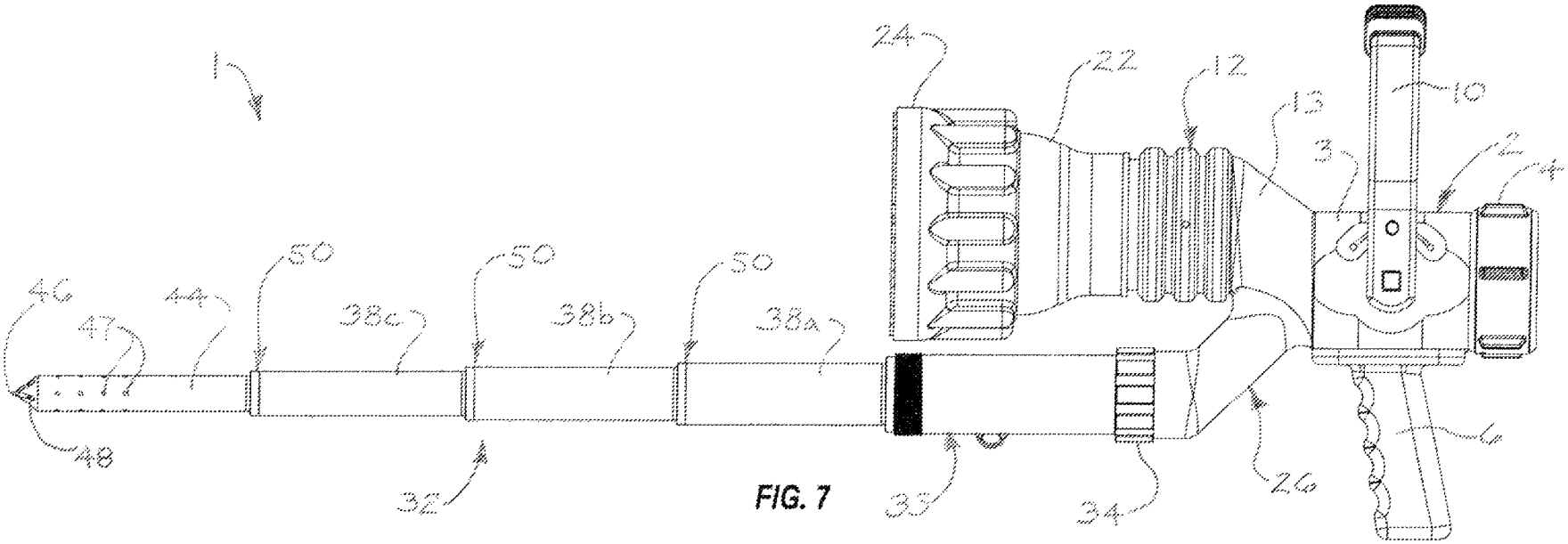
FIG. 7 is a left side view of the illustrative barrier piercing firehose nozzle assembly with the barrier-piercing applicator in an extended, functional position.
Figure 8:
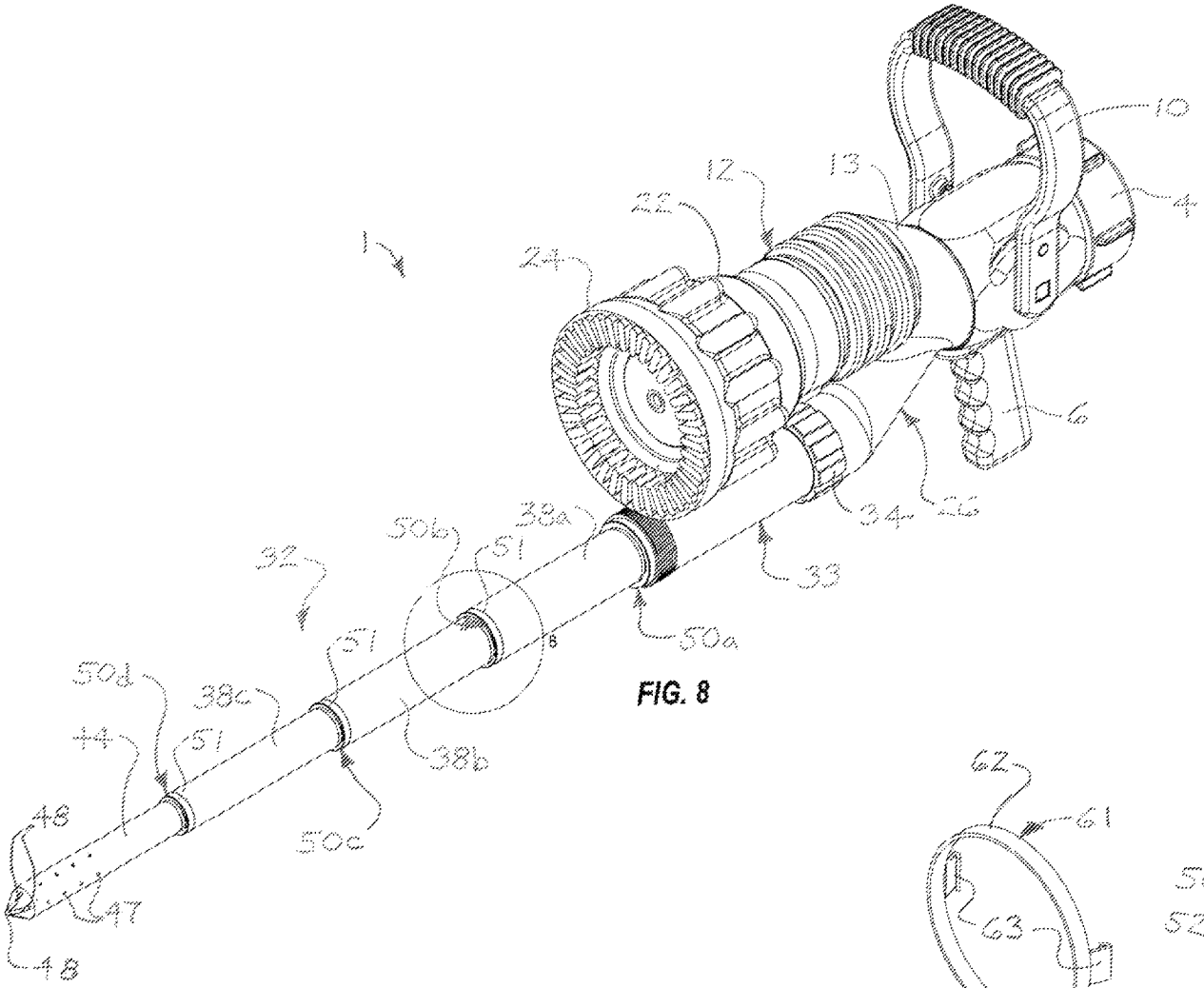
FIG. 8 is a left front perspective view of the illustrative barrier piercing firehose nozzle assembly with the barrier-piercing applicator in the extended position.
Figure 14:
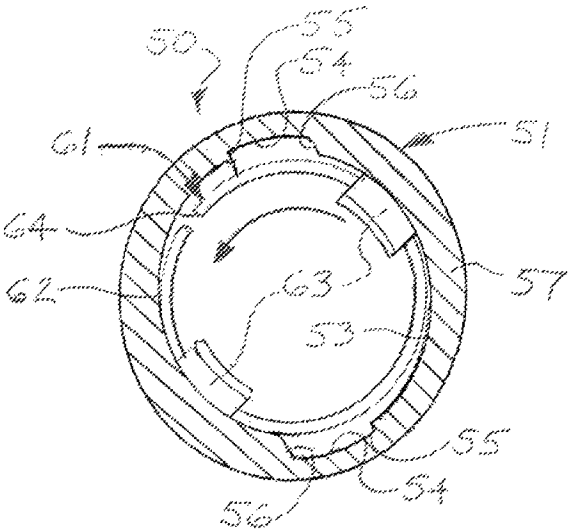
FIG. 14 is a sectional view of the female lock ring with the lock tabs on the male lock ring disengaging the respective lock tab seats in the female lock ring in a release configuration of the segment locking mechanism.
Figure 15:
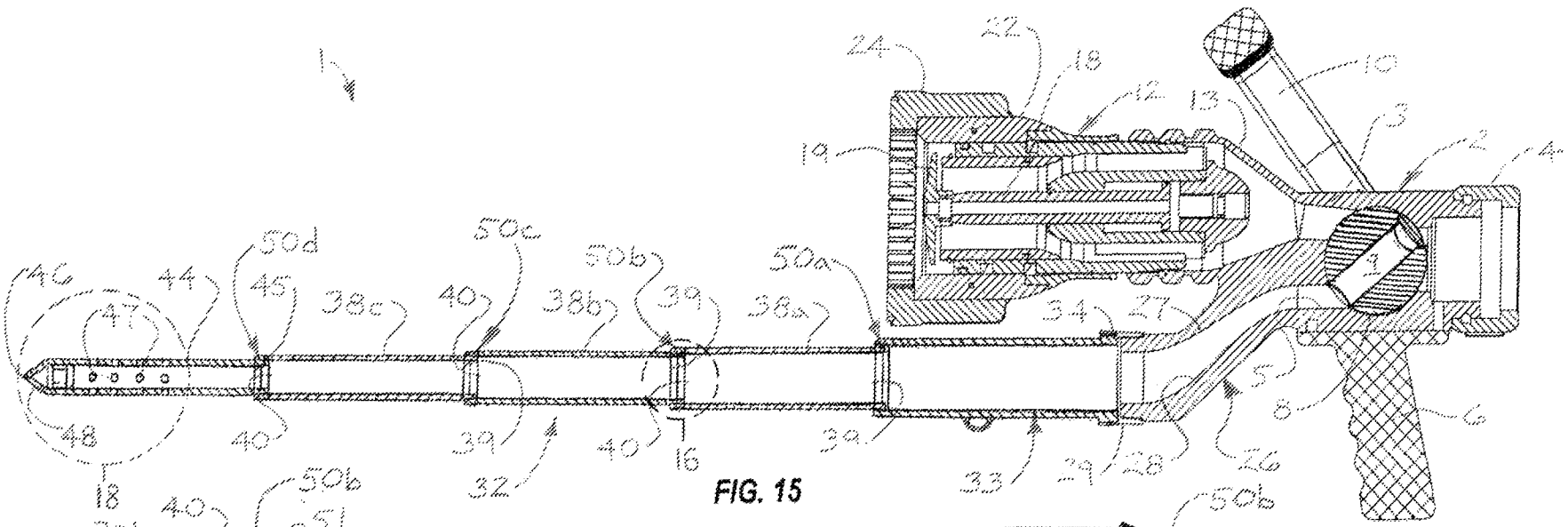
FIG. 15 is a longitudinal sectional view of the barrier piercing firehose nozzle assembly with the barrier-piercing applicator in the extended position and the selector handle shown a forward handle position for ejection of water from the applicator.

Referring next to FIGS. 1-18 of the drawings, the assembly 1 may include a nozzle inlet housing 2. As illustrated in FIGS. 5, 6 and 15, the nozzle inlet housing 2 may have an inlet housing interior 5. A spray nozzle 12 may be disposed in fluid communication with the inlet housing interior 5 of the nozzle inlet housing 2. A barrier-piercing applicator 32 may be disposed in fluid communication with the inlet housing interior 5. The barrier-piercing applicator 32 may be selectively deployable between a retracted position, illustrated in FIGS. 1-6, and an extended position, as illustrated in FIGS. 7, 8 and 15. As particularly illustrated in FIG. 18, at least one discharge opening 47, 48, 49 may be provided in the barrier-piercing applicator 32. The nozzle inlet housing 2, spray nozzle 12, barrier-piercing applicator 32 and other components of the assembly 1 may be fabricated of metal, metal alloys, composite materials and/or other materials which are consistent with the functional requirements of the assembly 1 using casting, molding, machining and/or other fabrication methods which are known by those skilled in the art.

The nozzle inlet housing 2 may include an inlet housing wall 3 which defines the inlet housing interior 5. A hose coupling 4 may be provided on the inlet housing wall 3. The hose coupling 4 may facilitate coupling of the nozzle inlet housing 2 to a fire hose 81 (FIG. 18) in typical application of the assembly 1, which will be hereinafter described. A handle 6 may extend from the inlet housing wall 3 for carrying and positioning purposes.

As further illustrated in FIGS. 5, 6 and 15, a selector valve 8 may be provided in the inlet housing interior 5 of the nozzle inlet housing 2. The selector valve 8 may have a selector valve passage 9. The selector valve 8 may be selectively deployable in a neutral valve position, illustrated in FIG. 5; a nozzle valve position, illustrated in FIG. 6; or an applicator valve position, illustrated in FIG. 15. In the neutral valve position (FIG. 5), the selector valve passage 9 of the selector valve 8 may be positioned between the spray nozzle 12 and the barrier-piercing applicator 32, and thus, blocked from fluid communication with both the spray nozzle 12 and the barrier-piercing applicator 32. In the nozzle valve position of the selector valve 8 (FIG. 6), the selector valve passage 9 may be disposed in fluid communication with the spray nozzle 12. In the applicator valve position of the selector valve 8 (FIG. 15), the selector valve passage 9 may be disposed in fluid communication with the barrier-piercing applicator 32.

Figure 2:
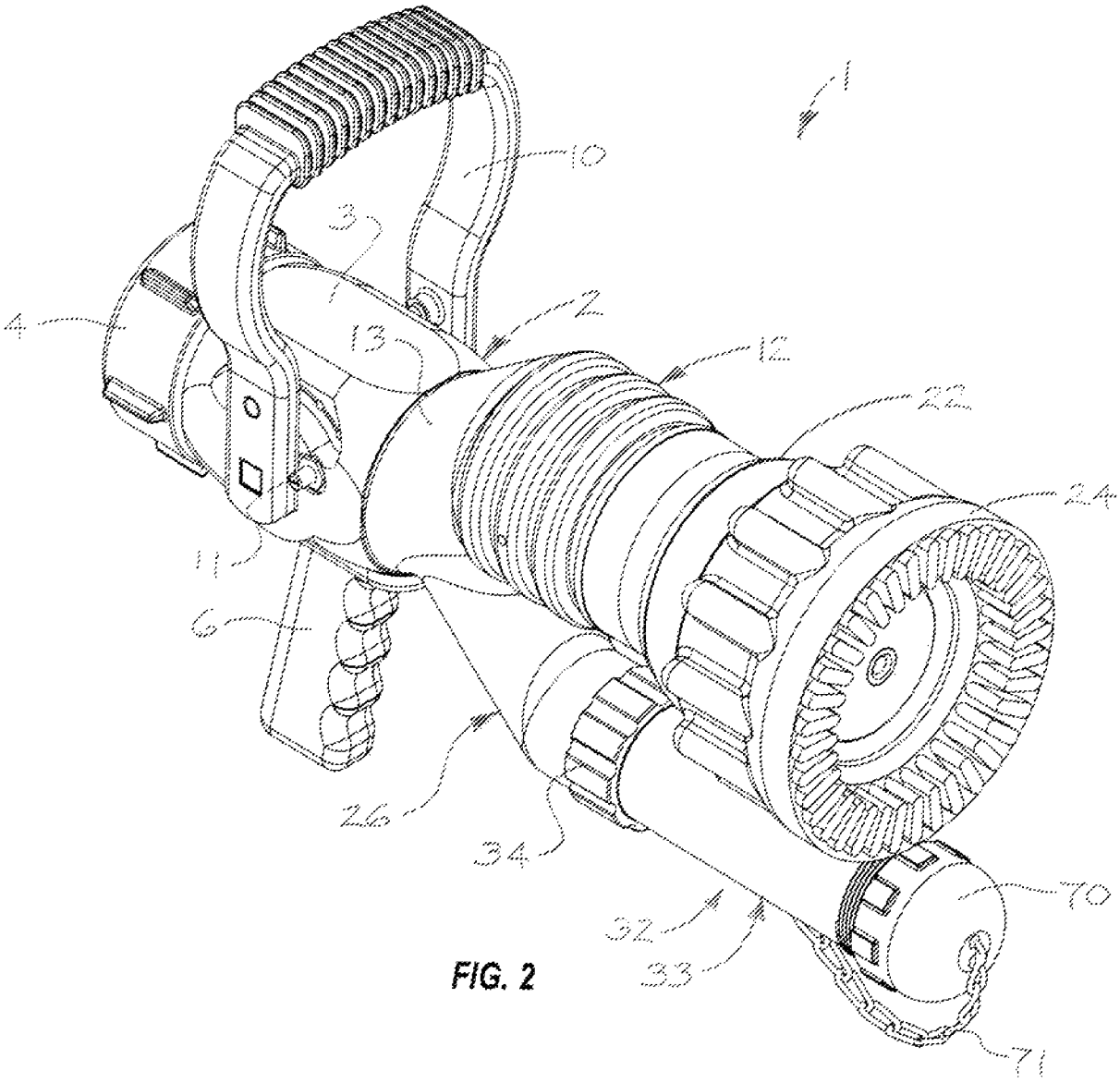
FIG. 2 is a front right-side perspective view of an illustrative embodiment of the barrier piercing firehose nozzle assemblies, with the barrier-piercing applicator shown in the retracted position.
Figure 3:
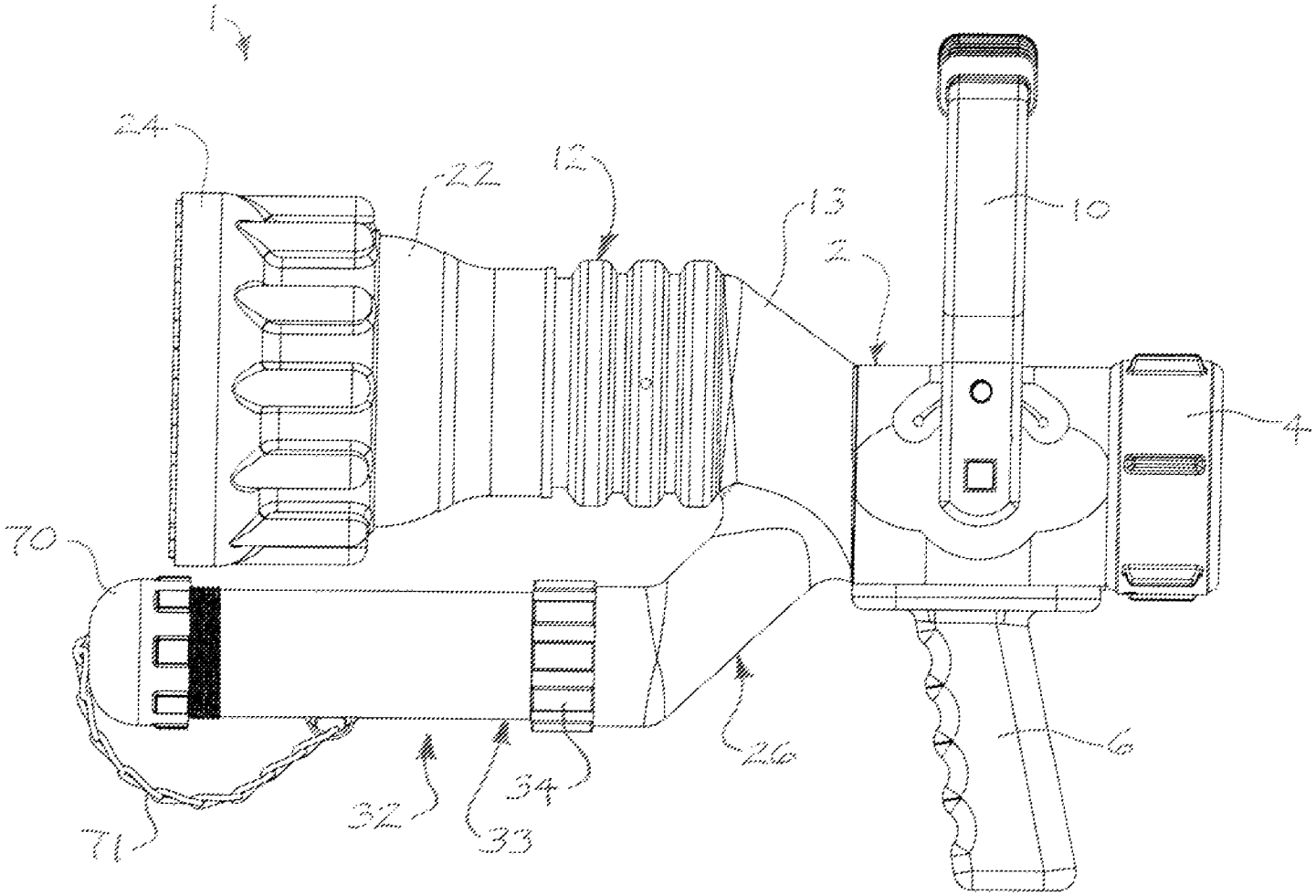
FIG. 3 is a left side view of the illustrative barrier piercing firehose nozzle assembly and retracted barrier-piercing applicator.
Figure 4:
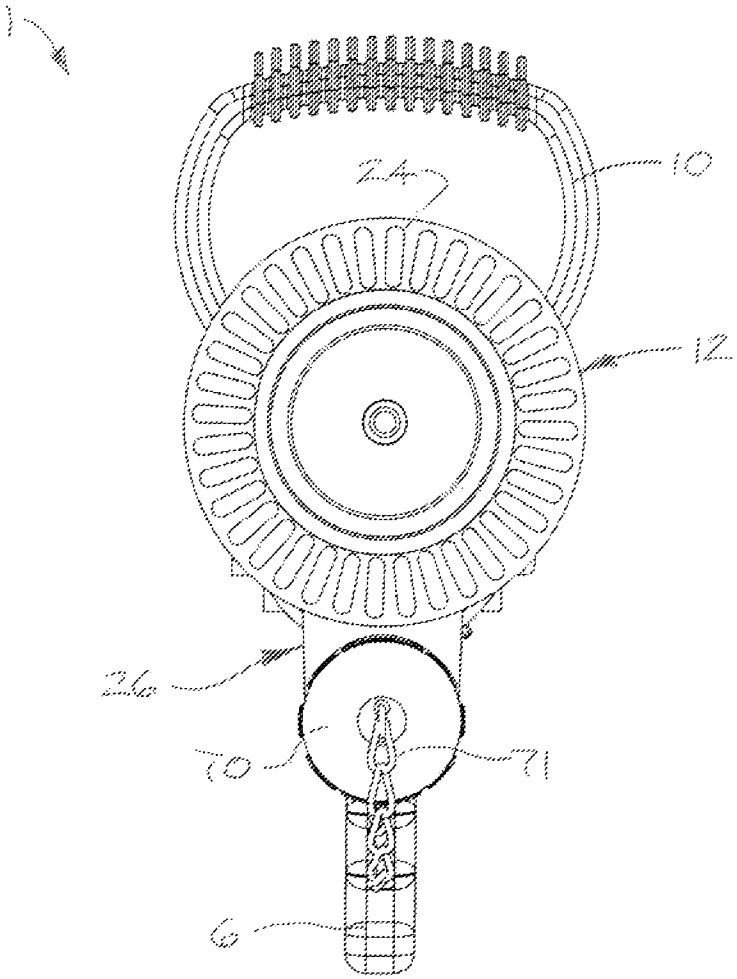
FIG. 4 is a front view of the illustrative barrier piercing firehose nozzle assembly and retracted barrier-piercing applicator.

The selector valve 8 may be rotatably mounted in the inlet housing interior 5. A selector handle 10 may engage the selector valve 8 to facilitate positioning of the selector valve 8 to the neutral, nozzle and applicator valve positions within the inlet housing interior 5. As illustrated in FIGS. 5, 6 and 15, the selector handle 10 typically may be selectively deployed in a middle handle position (FIG. 5), a rear handle position (FIG. 6) or a forward handle position (FIG. 15) to orient the selector valve 8 in the neutral valve position, the nozzle valve position and the applicator valve position, respectively. As illustrated in FIG. 2, in some embodiments, a handle lock pin 11 may be provided on the nozzle inlet housing 2. The handle lock pin 11 may facilitate locking of the selector handle 10 in the selected neutral handle position on the nozzle inlet housing 2 according to the knowledge of those skilled in the art.

The functional components of the spray nozzle 12 may be standard or conventional and may have any design which is known by those skilled in the art and suitable for the purpose of discharging the water 82 in a spray pattern from the assembly 1. As further illustrated in FIG. 5, the spray nozzle portion 12 may have a nozzle wall 13 which extends from the inlet housing wall 3 of the nozzle inlet housing 2. The nozzle wall 13 of the spray nozzle 12 may be cast, molded or otherwise fabricated in one piece with the inlet housing wall 3 of the nozzle inlet housing 2. Alternatively, the inlet housing wall 3 and the nozzle wall 13 may be fabricated separately and attached using techniques known by those skilled in the art.

A tube support member 16 may be provided in the spray nozzle portion 12. An elongated nozzle tube 18 may be supported by the tube support member 16. The nozzle tube 18 may have a nozzle tube end piece 19. A nozzle head 22 may be provided on the nozzle wall 13 of the spray nozzle portion 12. A water effect selector 24, having nozzle openings 25, may be rotatably mounted on the nozzle head 22. Accordingly, in operation of the spray nozzle 12 in typical application of the assembly 1, which will be hereinafter described, the water 82 may flow from the firehose 81 (FIG. 18) through the hose coupling 4, the selector valve passage 9 of the selector valve 8, the tube support member 16, the nozzle tube 18 and the nozzle tube end piece 19, respectively. The water 82 may be sprayed from the water effect selector 24 through the nozzle openings 25. In some embodiments, the water effect selector 24 may be rotated to vary the spray pattern and characteristics of the water 82 as it is discharged from the water effect selector 24, as is known by those skilled in the art.

An applicator connecting portion 26 may extend from the nozzle inlet housing 2. As illustrated in FIG. 5, the applicator connecting portion 26 may include a connecting portion wall 27 which may extend from the inlet housing wall 3 of the nozzle inlet housing 2. A connecting portion passage 28 may be formed by the connecting portion wall 27. An applicator coupling 29 may terminate the connecting portion wall 27. The connecting portion passage 28 may be disposed in fluid communication with the selector valve passage 9 when the selector valve 8 is disposed in the applicator valve position, as illustrated in FIG. 15.

In some embodiments, the barrier-piercing applicator 32 may be cast, molded or otherwise fabricated in one piece with the applicator connecting portion 26. In other embodiments, the barrier-piercing applicator 32 may be releasably coupled to the applicator coupling 29 of the applicator connecting portion 26 typically in a manner which will be hereinafter described. The barrier-piercing applicator 32 may be selectively extendible and retractable according to the knowledge of those skilled in the art. In some embodiments, the barrier-piercing applicator 32 may be selectively telescopically extendable. Accordingly, the barrier-piercing applicator 32 may include an applicator base housing 33. As illustrated in FIG. 15, in some embodiments, the applicator base housing 33 may include a housing coupling 34 which may be threadably coupled and/or otherwise releasably or fixedly attached to the applicator coupling 29 on the applicator connecting portion 26.

At least one intermediate applicator segment 38 may be disposed in fluid communication with and telescopically extendable from and retractable into the applicator base housing 33. A terminal applicator segment 44 may be disposed in fluid communication with and telescopically extendable from and retractable into the intermediate applicator segment or segments 38. In the non-limiting example illustrated in FIG. 15, the barrier-piercing applicator 32 includes first, second and third intermediate applicator segments 38*a*, 38*b* and 38*c*, respectively. Each intermediate applicator segment 38 may have an inlet end 39 and an outlet end 40. The inlet end 39 of the first intermediate applicator segment 38*a* may interface with the applicator base housing 33. The inlet end 39 of the second intermediate applicator segment 38*b* may interface with the outlet end 40 of the first intermediate applicator segment 38*a*. The inlet end 39 of the third intermediate applicator segment 38*c* may interface with the outlet end 40 of the second intermediate applicator segment 38*b*. The terminal applicator segment 44 may include an inlet end 45 which interfaces with the outlet end 40 of the intermediate applicator segment 38*c*. A pointed or tapered discharge end 46 may terminate the terminal applicator segment 44 opposite the inlet end 45. The barrier-piercing applicator 32 may include any desired number of the intermediate applicator segments 38 between the applicator base housing 33 and the terminal applicator segment 44.

Figure 18:
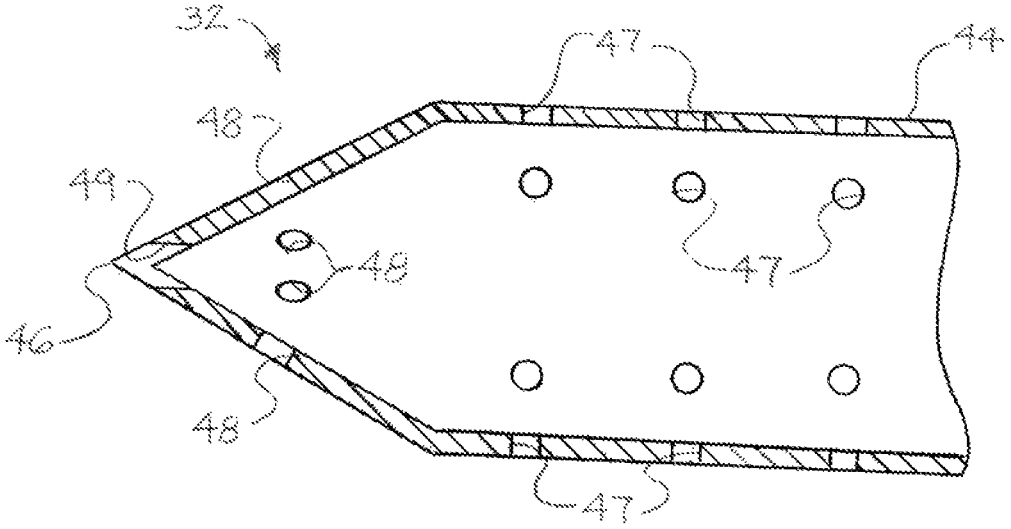
FIG. 18 is an enlarged sectional view of the terminal applicator segment of the barrier-piercing applicator, taken along section line 18 in FIG. 15.

As illustrated in FIG. 18, multiple discharge openings 47, 48, 49 may be provided in the terminal applicator segment 44 of the barrier-piercing applicator 32 for purposes which will be hereinafter described. Accordingly, in some embodiments, side discharge openings 47 may be provided in the terminal applicator segment 44 in a selected number, pattern and spacing. Tapered discharge openings 48 may be provided in the tapered portion of the tapered discharge end 46 of the terminal applicator segment 44 in a selected number, pattern and spacing. A single terminal discharge opening 49 may be provided in the apex of the discharge end 46 of the terminal applicator segment 44.

As illustrated in FIGS. 9-17, multiple segment locking mechanisms 50 may couple the intermediate applicator segment or segments 38 to the applicator base housing 33 and to each other and the terminal applicator segment 44 to the intermediate applicator segment or segments 38. In some applications of the assembly 1, which will be hereinafter described, the segment locking mechanisms 50 may normally maintain or secure the barrier-piercing applicator 32 in the extended position. The segment locking mechanisms 50 may additionally facilitate selective disengagement or release of the intermediate applicator segment or segments 38 from the applicator base housing 33 and each other and the terminal applicator segment 44 from the intermediate applicator segment or segments 38 to facilitate telescopic retraction of the barrier-piercing applicator 32 when not in use.

Figure 10:
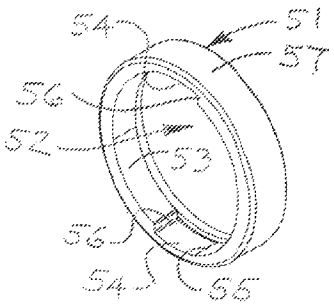
FIG. 10 is a perspective view of a typical female lock ring component of the segment locking mechanism.
Figure 11:
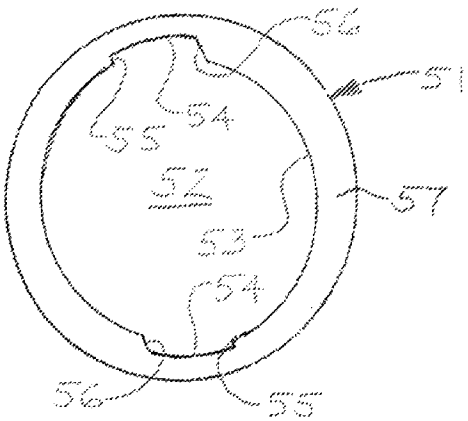
FIG. 11 is a front view of the female lock ring.

The segment locking mechanisms 50 may have any design which is suitable to releasably lock or secure the barrier-piercing applicator 32 in the extended position. As illustrated in FIGS. 13, 14, 16 and 17, in some embodiments, each segment locking mechanism 50 may include a female lock ring 51 and an interfacing male lock ring 61. As illustrated in FIGS. 10 and 11, the female lock ring 51 of each segment locking mechanism 50 may have an annular female lock ring body 57 with a female lock ring opening 52. The female lock ring body 57 may have an interior ring surface 53 which faces the female lock ring opening 52. At least one lock tab seat 54 may be provided in the interior ring surface 53. In some embodiments, a pair of spaced-apart lock tab seats 54 may be provided in the interior ring surface 53 typically in diametrically-opposed relationship to each other. As particularly illustrated in FIG. 11, each lock tab seat 54 may have a straight or radial tab retaining edge 55 and a slanted beveled edge 56 which is opposite the tab retaining edge 55.

Figure 9:
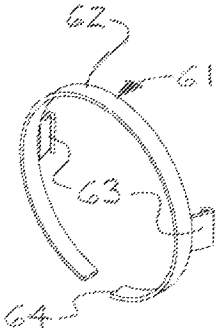
FIG. 9 is a perspective view of a typical male lock ring component of a typical segment locking mechanism which is suitable for locking the barrier-piercing applicator segments of the applicator in the extended position.
Figure 12:
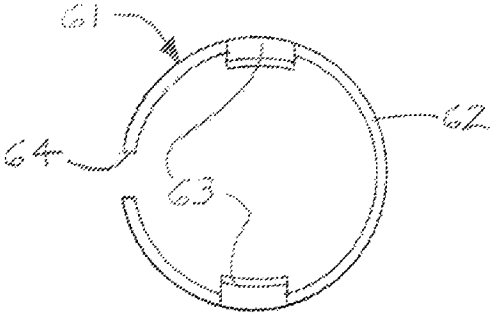
FIG. 12 is a front view of the male lock ring.

As illustrated in FIGS. 9 and 12, the male lock ring 61 of each segment locking mechanism 50 may have an annular lock ring body 62. A ring gap 64 may interrupt the lock ring body 62. At least one lock ring tab 63 may protrude from the lock ring body 62. In some embodiments, a pair of spaced-apart lock ring tabs 63 may extend from the lock ring body 62 typically in diametrically-opposed relationship to each other. Accordingly, the lock ring tabs 63 on the male lock ring 61 may correspond in position to the respective lock tab seats 54 in the interior ring surface 53 of the female lock ring 51. The lock ring body 62 and lock ring tabs 63 of each segment locking mechanism 50 may be fabricated of spring steel or other flexible or resilient material which is suitable for the purpose.

Figure 17:
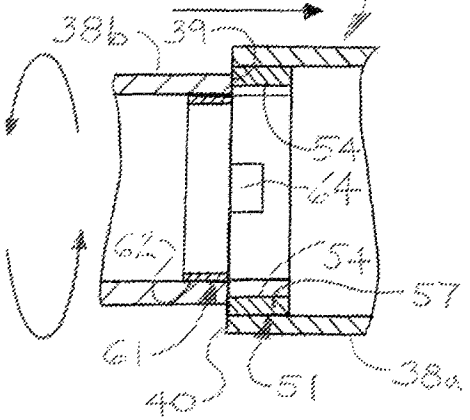
FIG. 17 is an enlarged sectional view, also taken along section line 16 in FIG. 15, of the segment locking mechanism in the release configuration.
Figure 16:
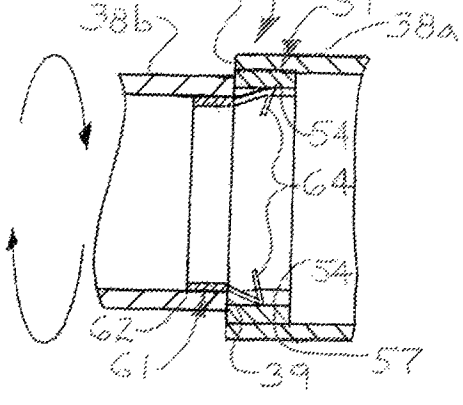
FIG. 16 is an enlarged sectional view, taken along section line 16 in FIG. 15, of the segment locking mechanism in the lock configuration.

As illustrated in FIGS. 15-17, the female lock ring 51 of each segment locking mechanism 50 may be provided on a corresponding first one of the application base housing 33, the at least one intermediate applicator segment 38 and the terminal applicator segment 44. The companion male lock ring 61 of each segment locking mechanism 50 may be provided on a corresponding interfacing second one of the application base housing 33, the at least one intermediate applicator segment 38 and the terminal applicator segment 44. In some embodiments, such as that illustrated in FIG. 15, a first segment locking mechanism 50*a* may include a female lock ring 51 on the applicator base housing 33 and a male lock ring 61 on the interfacing inlet end 39 of the first intermediate applicator segment 38*a*. A second segment locking mechanism 50*b* may include a female lock ring 51 on the outlet end 40 of the first intermediate applicator segment 38*a* and a male lock ring 61 on the interfacing inlet end 39 of the second intermediate applicator segment 38*b*. A third segment locking mechanism 50*c* may include a female lock ring 51 on the outlet end 40 of the second intermediate applicator segment 38*b* and a male lock ring 61 on the interfacing inlet end 39 of the third intermediate applicator segment 38*c*. A fourth segment locking mechanism 50*d* may include a female lock ring 51 on the outlet end 40 of the third intermediate applicator segment 38*c* and a male lock ring 61 on the interfacing inlet end 45 of the terminal applicator segment 44. In alternative embodiments, the positions of the female lock ring 51 and the male lock ring 61 in each segment locking mechanism 50 may be reversed. Thus, the male lock rings 61 of the segment locking mechanisms 50 may be provided on the respective applicator base housing 33 and the outlet ends 40 of the respective intermediate applicator segments 38, whereas the female lock rings 51 of the respective segment locking mechanisms 50 may be provided on the respective inlet ends 39 of the intermediate applicator segments 38 and the inlet end 45 of the terminal applicator segment 44.

In some embodiments, the female lock ring 51 and male lock ring 61 of each segment locking mechanism 50 may be fabricated separately and attached to the corresponding application base housing 33, intermediate applicator segment 38 and terminal applicator segment 44 using techniques known by those skilled in the art. In other embodiments, the female lock ring 51 and male lock ring 61 of each segment locking mechanism 50 may be machined in or fabricated in one piece with the corresponding application base housing 33, intermediate applicator segment 38 and terminal applicator segment 44 according to the knowledge of those skilled in the art.

Figure 13:
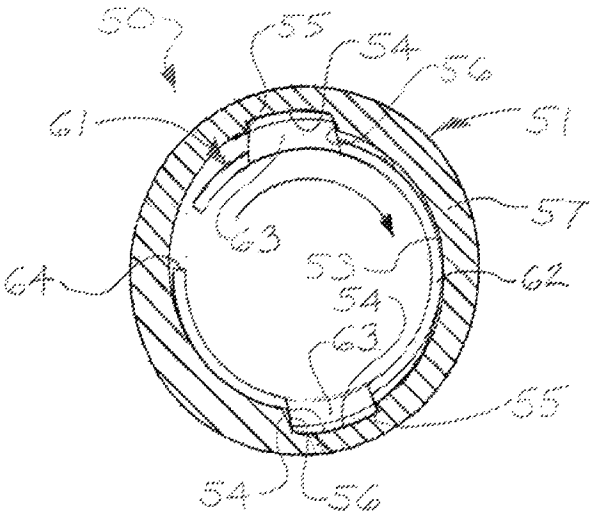
FIG. 13 is a sectional view of the female lock ring with a pair of lock tabs on the male lock ring engaging a pair of respective companion lock tab seats in the female lock ring in a lock configuration of the segment locking mechanism.

In application of the assembly 1, which will be hereinafter described, the barrier-piercing applicator 32 may be deployed from the retracted position to the extended position by the force of the water 82 as it flows from the applicator connecting portion 26 through the applicator base housing 33, the intermediate applicator segment or segments 38 and the terminal applicator segment 44, respectively. As the barrier-piercing applicator 32 extends, the segment locking mechanisms 50 may be disposed in the release configuration in which the lock ring tabs 63 on the male lock ring 61 disengage the respective lock tab seats 54 in the female lock ring 51, as illustrated in FIGS. 14 and 17, to enable the intermediate applicator segments 38 to slide freely with respect to and from the applicator base housing 33 and each other and the terminal applicator segment 44 to slide freely with respect to and from its interfacing intermediate applicator segment 38. After the barrier-piercing applicator 32 has been extended from the applicator connecting portion 26, the locking mechanisms 50 may be deployed in the lock configuration. Accordingly, the intermediate applicator segments 38 may be manually rotated or twisted sequentially with respect to the applicator base housing 33 and each other and the terminal applicator segment 44 rotated or twisted with respect to its interfacing intermediate applicator segment 38, as indicated by the arrow in FIGS. 14 and 17, to snap the lock ring tabs 63 on each male lock ring 61 of each segment locking mechanism 50 into the respective companion lock tab seats 54 in the female lock ring 51, as illustrated in FIGS. 13 and 16, typically responsive to the outward recoil bias of the lock ring body 62. Thus, the ring gap 64 in the lock ring body 62 may widen as the lock ring body 62 expands outwardly to firmly seat the lock ring tabs 63 in the respective lock tab seats 54. The seated lock ring tabs 63 on the male lock ring 61 of each segment locking mechanism 50 may secure the barrier-piercing applicator 32 in the extended position and prevent inadvertent telescopic retraction of the barrier-piercing applicator 32 into the applicator connecting portion 26.

After use of the barrier-piercing applicator 32 is completed and flow of the water 82 through the extended barrier-piercing applicator 32 terminated, the barrier-piercing applicator 32 may be selectively retracted into the applicator connecting portion 26, as illustrated in FIGS. 1-6. This may be accomplished by first manually rotating or twisting the terminal applicator segment 44 with respect to its interfacing intermediate applicator segment 38 and rotating or twisting the intermediate applicator segments 38 with respect to each other and the applicator base housing 33, respectively, as indicated by the arrows in FIGS. 13 and 16. This rotating or twisting action may facilitate deployment of the segment locking mechanisms 50 from the lock configuration to the release configuration by disengaging and unseating the lock ring tabs 63 on the male lock ring 61 from the respective companion lock tab seats 54 in the female lock ring 51 as the lock ring tabs 63 typically first traverse the respective beveled edges 56 of the lock tab seats 54 and then traverse the interior ring surface 53 of the female lock ring 51. Accordingly, the released terminal applicator segment 44 may be telescopically pushed into the intermediate applicator segments 38 and the released intermediate applicator segments 38 pushed into the applicator base housing 33. As further illustrated in FIGS. 1-6, in some embodiments, a typically dome-shaped protective cap 70 may be deployed in place over the discharge end 46 of the terminal applicator segment 44 when the barrier-piercing applicator 32 is deployed in the retracted position and not in use. A cap lanyard 71 may tether the protective cap 70 to the applicator base housing 33, as illustrated, or the applicator connecting portion 26 of the nozzle inlet housing 2.

Referring next to FIGS. 5, 6 and 19 of the drawings, in some applications, the assembly 1 may be used to extinguish an open fire 83 (FIG. 19) which is outdoors and/or within a building or other structure (not illustrated). Accordingly, a firetruck 78 may be connected to a fire hydrant 79 through a fire hydrant hose 80. The assembly 1 may be connected to the firetruck 78 through a firehose 81, typically by threaded engagement of the hose coupling 4 (FIG. 6) on the nozzle inlet housing 2 of the assembly 1 with a companion threaded nozzle coupling (not illustrated) on the discharge end of the firehose 81.

As a firefighter 84 typically holds the assembly 1, water 82 may be pumped from the fire hydrant 79 to the firetruck 78 through the fire hydrant hose 80, and subsequently from the firetruck 78 to the assembly 1 through the firehose 81. The firefighter 84 may pivot the selector handle 10 typically from the neutral middle handle position illustrated in FIG. 5 to the rear handle position illustrated in FIG. 6. Accordingly, water 82 may flow under pressure from the firetruck 78 through the firehose 81 and the selector valve passage 9 of the selector valve 8, respectively, and then through the tube support member 16, the nozzle tube 18 and the nozzle tube end piece 19, respectively, in the nozzle head 22 of the spray nozzle 12. The water 82 may be ejected from the nozzle openings 25 in the water effect selector 24 in a spray pattern onto the fire 83. In some applications, the water effect selector 24 may be rotated on the nozzle head 22 to vary the spray pattern of the water 82 as it exits the nozzle openings 25 in the water effect selector 24 typically depending on the size of the fire 83, as is known by those skilled in the art. Application of the water 82 to the fire 83 may continue until the fire 83 is extinguished, after which the selector handle 10 may be returned to the middle neutral handle position illustrated in FIG. 5 to terminate further ejection of the water 82 from the spray nozzle 12.

Referring next to FIGS. 5, 13-17 and 20 of the drawings, in some applications, the assembly 1 may be used to extinguish a fire 83 (FIG. 20) above a ceiling 88 or on the other side of a floor, wall or other barrier (not illustrated). Accordingly, the assembly 1 may be connected to the firetruck 78 (FIG. 19) through the firehose 81, typically as was heretofore described. The selector handle 10 may be pivoted typically from the neutral middle handle position (FIG. 5) to the forward handle position illustrated in FIG. 15. Accordingly, water 82 may flow under pressure from the firetruck 78 through the firehose 81 and the selector valve passage 9 of the selector valve 8, respectively, and then through the connecting portion passage 28 in the applicator connecting portion 26. The water 82 may then flow through the applicator base housing 33 and then into and through the respective intermediate applicator segments 38 and the terminal applicator segment 44, respectively, of the barrier-piercing applicator 32. As it flows through the intermediate applicator segments 38 and the terminal applicator segment 44, the force of the flowing water 82 may successively telescopically extend the intermediate applicator segments 38 from the applicator base housing 33 and each other and the terminal applicator segment 44 from its interfacing intermediate applicator segment 38. The water 82 may be ejected from the terminal applicator segment 44 through the side discharge openings 47, the tapered discharge openings 48 and/or the terminal discharge opening 49.

After the barrier-piercing applicator 32 is telescopically extended, the firefighter 84 (FIG. 19) may sequentially rotate or twist the intermediate applicator segment 38 with respect to its interfacing applicator base housing 33, the interfacing intermediate applicator segments 38 with respect to each other and the terminal applicator segment 44 with respect to its interfacing intermediate applicator segment 38. This rotating or twisting action may facilitate engagement of the lock ring tabs 63 on the male lock ring 61 with the respective companion lock tab seats 54 in the female lock ring 51 of each corresponding segment locking mechanism 50, from the release configuration illustrated in FIGS. 14 and 17 to the lock configuration illustrated in FIGS. 13 and 16, as was heretofore described, to lock or secure the barrier-piercing applicator 32 in the extended position.

As illustrated in FIG. 20, the barrier-piercing applicator 32 may be forcefully extended through the ceiling 88 or other barrier and deployed adjacent to the fire 83 typically by striking the discharge end 46 against and forming a puncture opening 89 through which the barrier-piercing applicator 32 is extended in the ceiling 88 adjacent to the fire 83. Accordingly, the water 82 may be ejected from the terminal segment 44 through the side discharge openings 47, the tapered discharge openings 48 and/or the terminal discharge opening 49 onto the fire 83. Application of the water 82 to the fire 83 may continue until the fire 83 is extinguished, after which the selector handle 10 may be returned to the middle neutral handle position illustrated in FIG. 5 and the barrier-piercing applicator 32 retrieved from the puncture opening 89. The barrier-piercing applicator 32 may be returned to the retracted position by sequentially rotating or twisting the terminal applicator segment 44 with respect to the interfacing intermediate applicator segment 38, the interfacing intermediate applicator segments 38 with respect to each other and the intermediate applicator segment 38 with respect to the interfacing applicator base housing 33, as indicated by the arrows in FIGS. 13 and 16. This rotating or twisting action may facilitate disengagement of the lock ring tabs 63 on the male lock ring 61 from the respective lock tab seats 54 in the female lock ring 51 of each corresponding segment locking mechanism 50, from the lock configuration illustrated in FIGS. 13 and 16 to the release configuration illustrated in FIGS. 14 and 17. As illustrated in FIGS. 1-6, in some applications, the protective cap 70 may be secured in place over the discharge end 46 of the retracted terminal applicator segment 44.

While illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A barrier piercing firehose nozzle assembly, comprising:

a nozzle inlet housing having a first inlet housing end, a second inlet housing end and an inlet housing interior extending from the first inlet housing end to the second inlet housing end;

a hose coupling at the first inlet housing end of the nozzle inlet housing, the hose coupling configured to facilitate coupling of the nozzle inlet housing to a fire hose;

a spray nozzle disposed in fluid communication with the inlet housing interior at the second inlet housing end of the nozzle inlet housing;

a barrier-piercing applicator disposed in fluid communication with the inlet housing interior at the second inlet housing end of the nozzle inlet housing in adjacent and parallel relationship to the spray nozzle, the barrier-piercing applicator selectively telescopically deployable between a retracted position and an extended position and including:

an applicator base housing disposed in fluid communication with the inlet housing interior;

at least one intermediate applicator segment disposed in fluid communication with and telescopically-extendable from the applicator base housing;

a terminal applicator segment disposed in fluid communication with and telescopically-extendable from the at least one intermediate applicator segment;

a plurality of segment locking mechanisms on the barrier-piercing applicator and configured to releasably secure the barrier-piercing applicator in the extended position, each of the plurality of segment locking mechanisms comprising:

a male lock ring carried by a first corresponding one of the applicator base housing, the at least one intermediate applicator segment and the terminal applicator segment, the male lock ring having at least one lock tab; and a female lock ring carried by a second corresponding interfacing one of the applicator base housing, the at least one intermediate applicator segment and the terminal applicator segment, the female lock ring having at least one lock tab seat configured to accommodate the at least one lock tab of the male lock ring in the extended position of the barrier-piercing applicator and configured to release the at least one lock tab of the male lock ring responsive to selective rotation of the second corresponding interfacing one of the applicator base housing, the at least one intermediate applicator segment and the terminal applicator segment with respect to the first corresponding one of the applicator base housing, the at least one intermediate applicator segment and the terminal applicator segment, respectively; and at least one discharge opening in the terminal applicator segment; and a selector valve in the inlet housing interior, the selector valve selectively deployable in a first valve position wherein the selector valve establishes fluid communication between the hose coupling and the spray nozzle and a second valve position wherein the selector valve establishes fluid communication between the hose coupling and the barrier-piercing applicator.

2. The barrier piercing firehose nozzle assembly of claim 1 further comprising an applicator connecting portion disposed in fluid communication with the inlet housing interior at the second inlet housing end of the nozzle inlet housing, and wherein the barrier-piercing applicator is disposed in fluid communication with the applicator connecting portion.

3. The barrier piercing firehose nozzle assembly of claim 2 further comprising an applicator coupling on the applicator connecting portion, and wherein the barrier-piercing applicator is detachably coupled to the applicator connecting portion at the applicator coupling.

4. The barrier piercing firehose nozzle assembly of claim 1 further comprising a selector handle pivotally carried by the nozzle inlet housing and coupled to the selector valve, the selector handle selectively deployable in a first handle position wherein the selector valve establishes fluid communication between the hose coupling and the spray nozzle and a second handle position wherein the selector valve establishes fluid communication between the hose coupling and the barrier-piercing applicator.

5. The barrier piercing firehose nozzle assembly of claim 4 wherein the selector handle is selectively deployable in a third handle position wherein fluid communication between the hose coupling and the spray nozzle and between the hose coupling and the barrier-piercing applicator is blocked.

6. The barrier piercing firehose nozzle assembly of claim 5 wherein the selector valve comprises a selector valve passage establishing fluid communication between the hose coupling and the spray nozzle in the first handle position and between the hose coupling and the barrier-piercing applicator in the second handle position.

7. A barrier piercing firehose nozzle assembly, comprising:

a nozzle inlet housing having a first inlet housing end, a second inlet housing end and an inlet housing interior extending from the first inlet housing end to the second inlet housing end;

a hose coupling at the first inlet housing end of the nozzle inlet housing, the hose coupling configured to facilitate coupling of the nozzle inlet housing to a fire hose;

a spray nozzle disposed in fluid communication with the inlet housing interior at the second inlet housing end of the nozzle inlet housing;

an applicator connecting portion disposed in fluid communication with the inlet housing interior at the second inlet housing end of the nozzle inlet housing and in adjacent and parallel relationship to the spray nozzle;

an applicator coupling carried by the applicator connecting portion;

a barrier-piercing applicator disposed in fluid communication with the applicator connecting portion, the barrier-piercing applicator selectively telescopically deployable between a retracted position and an extended position and including:

an applicator base housing disposed in fluid communication with the inlet housing interior, the applicator base housing having a housing coupling coupled to the applicator coupling of the applicator connecting portion;

at least one intermediate applicator segment disposed in fluid communication with and telescopically-extendable from the applicator base housing;

a terminal applicator segment disposed in fluid communication with and telescopically-extendable from the at least one intermediate applicator segment, the terminal applicator segment having a tapered discharge end;

at least one discharge opening in the terminal applicator segment;

a plurality of segment locking mechanisms on the barrier-piercing applicator and configured to releasably secure the barrier-piercing applicator in the extended position, each of the plurality of segment locking mechanisms comprising:

a male lock ring carried by a first corresponding one of the applicator base housing, the at least one intermediate applicator segment and the terminal applicator segment, the male lock ring having:

a lock ring body;

a ring gap interrupting the lock ring body; and at least one lock tab extending from the lock ring body; and a female lock ring carried by a second corresponding interfacing one of the applicator base housing, the at least one intermediate applicator segment and the terminal applicator segment, the female lock ring having:

a female lock ring body with a female lock ring opening;

an interior ring surface facing the female lock ring opening; and at least one lock tab seat in the interior ring surface, the at least one lock tab seat configured to accommodate the at least one lock tab of the male lock ring in the extended position of the barrier-piercing applicator and configured to release the at least one lock tab of the male lock ring responsive to selective rotation of the second corresponding interfacing one of the applicator base housing, the at least one intermediate applicator segment and the terminal applicator segment with respect to the first corresponding one of the applicator base housing, the at least one intermediate applicator segment and the terminal applicator segment; and a selector valve in the inlet housing interior, the selector valve selectively deployable in a first valve position wherein the selector valve establishes fluid communication between the hose coupling and the spray nozzle and a second valve position wherein the selector valve establishes fluid communication between the hose coupling and the barrier-piercing applicator.

8. The barrier piercing firehose nozzle assembly of claim 7 wherein the at least one discharge opening comprises at least one side discharge opening.

9. The barrier piercing firehose nozzle assembly of claim 7 wherein the at least one discharge opening comprises at least one tapered discharge opening.

10. The barrier piercing firehose nozzle assembly of claim 7 wherein the at least one discharge opening comprises a terminal discharge opening in the discharge end of the terminal applicator segment.

11. The barrier piercing firehose nozzle assembly of claim 7 further comprising a selector handle pivotally carried by the nozzle inlet housing and coupled to the selector valve, the selector handle selectively deployable in a first handle position wherein the selector valve establishes fluid communication between the hose coupling and the spray nozzle, a second handle position wherein the selector valve establishes fluid communication between the hose coupling and the applicator connecting portion and a third handle position wherein the selector valve blocks fluid communication between the hose coupling and the spray nozzle and between the hose coupling and the applicator connecting portion.

* * * * *